US011401689B2

(12) United States Patent
Ready-Campbell et al.

(10) Patent No.: US 11,401,689 B2
(45) Date of Patent: Aug. 2, 2022

(54) SENSOR RETROFIT TO AUTONOMOUSLY ACTUATE AN EXCAVATION VEHICLE

(71) Applicant: Built Robotics Inc., San Francisco, CA (US)

(72) Inventors: Noah Austen Ready-Campbell, San Francisco, CA (US); Andrew Xiao Liang, San Francisco, CA (US); Christian John Wawrzonek, San Francisco, CA (US); Gaurav Jitendra Kikani, San Francisco, CA (US); James Alan Emerick, San Francisco, CA (US); Lucas Allen Bruder, San Francisco, CA (US); Ammar Idris Kothari, San Francisco, CA (US)

(73) Assignee: BUILT ROBOTICS INC., San Francisco, CA (US)

( * ) Notice: Subject to any disclaimer, the term of this patent is extended or adjusted under 35 U.S.C. 154(b) by 152 days.

(21) Appl. No.: 16/817,600

(22) Filed: Mar. 12, 2020

(65) Prior Publication Data

US 2020/0291608 A1 Sep. 17, 2020

Related U.S. Application Data

(60) Provisional application No. 62/819,351, filed on Mar. 15, 2019.

(51) Int. Cl.

| | |
|---|---|
| ***E02F 9/20*** | (2006.01) |
| ***E02F 3/43*** | (2006.01) |
| ***E02F 9/26*** | (2006.01) |

(52) U.S. Cl.

CPC ..... *E02F 9/2037* (2013.01); *E02F 3/435* (2013.01); *E02F 9/2045* (2013.01); *E02F 9/26* (2013.01)

(58) Field of Classification Search

CPC ..... E02F 3/435; E02F 9/2037; E02F 9/2045; E02F 9/205; E02F 9/26; E02F 9/265

See application file for complete search history.

(56) References Cited

U.S. PATENT DOCUMENTS 5,810,095 A 9/1998 Orbach et al.
9,411,325 B2 * 8/2016 Baba ..... G05B 13/026
(Continued)

FOREIGN PATENT DOCUMENTS

JP 2008-133657 A 6/2008

OTHER PUBLICATIONS

International Search Report and Written Opinion, Patent Cooperation Treaty Application No. PCT/US2020/022500, dated Mar. 12, 2020, 23 pages.

*Primary Examiner* — Tyler J Lee
(74) *Attorney, Agent, or Firm* — Fenwick & West LLP

(57) ABSTRACT

An excavation vehicle capable of autonomously actuating an excavation tool or navigating an excavation vehicle to perform an excavation routine within an excavation site is described herein. Sensors mounted to the excavation vehicle and the excavation tool produce signals representative of a position and orientation of the corresponding joint relative on the excavation vehicle relative to the excavation site, a position and orientation of the excavation vehicle relative to the excavation site, and one or more features of the excavation site based on the position of the excavation vehicle within the excavation site. A set of solenoids are configured to couple to corresponding hydraulic valves of the excavation tool to actuate the valve. A controller produces actuating signals to control the joints of the excavation tool to autonomously perform the excavation routine based on the signals produced by the sensors.

20 Claims, 6 Drawing Sheets

(56) References Cited

U.S. PATENT DOCUMENTS

| | | | | |
|---|---|---|---|---|
| 9,856,628 | B2 * | 1/2018 | Kitajima | E02F 3/435 |
| 10,294,635 | B2 * | 5/2019 | Kurogi | B60R 1/00 |
| 2014/0088838 | A1 * | 3/2014 | Furem | G01G 19/14 701/50 |
| 2014/0297040 | A1 * | 10/2014 | Baba | E02F 9/2037 700/275 |
| 2015/0276468 | A1 * | 10/2015 | Jaeger | G01G 19/08 382/154 |
| 2016/0040391 | A1 | 2/2016 | Imaizumi et al. | |
| 2016/0251835 | A1 * | 9/2016 | Kitajima | E02F 3/32 701/50 |
| 2018/0245308 | A1 * | 8/2018 | Ready-Campbell | E02F 9/262 |
| 2018/0371723 | A1 | 12/2018 | Nishi et al. | |
| 2019/0003155 | A1 * | 1/2019 | Kurogi | E02F 9/26 |

* cited by examiner

SENSOR RETROFIT TO AUTONOMOUSLY ACTUATE AN EXCAVATION VEHICLE

CROSS REFERENCE TO RELATED APPLICATIONS

This application claims the benefit of U.S. Provisional Application No. 62/819,351, filed on Mar. 15, 2019, which is incorporated by reference in its entirety.

BACKGROUND

Field of Art

The disclosure relates generally to a method for performing excavation operations, and more specifically to performing excavation operations using a vehicle operated by a sensor assembly coupled to the vehicle to control the vehicle.

Description of the Related Art

Vehicles, for example backhoes, loaders, and excavators, generally categorized as excavation vehicles, are used to excavate earth from locations. Currently, operation of these excavation vehicles is very expensive as each vehicle requires a manual operator be available and present during the entire excavation. Further complicating the field, there is an insufficient labor force skilled enough to meet the demand for operating these vehicles. Because they must be operated manually, excavation can only be performed during the day, extending the duration of excavation projects and further increasing overall costs. The dependence of current excavation vehicles on manual operators increases the risk of human error during excavations and reduce the quality of work done at the site.

SUMMARY

Described is an autonomous or semi-autonomous excavation system retrofitted with a set of sensors configured to autonomously actuate movement of the excavation system. The excavation system autonomously actuates an excavation vehicle and an excavation tool mounted to the vehicle within a site using a combination of sensors integrated into the excavation vehicle and/or the conditions of the surrounding earth. Data recorded by the sensors may be aggregate or processed in various ways, for example, to determine the position of the excavation vehicle or excavation tool within the site, to generate a set of instructions for actuating the excavation tool to perform an excavation routine, and to perform other tasks described herein.

According to an embodiment, a set of sensors for enabling actuation in an excavation vehicle comprise a first set of one or more sensors, a second set of one or more sensors, a third set of one or more sensors, and controller. Each sensor of the first set is configured to couple to a corresponding joint of an excavation tool of the excavation vehicle and to produce a signal representative of a position and orientation of the corresponding joint relative to an excavation site. Each sensor of the second set is configured to couple to the excavation vehicle and to produce a signal representative of the position and orientation of the excavation vehicle relative to the excavation site. Each sensor of the third set is configured to couple to the excavation vehicle and to produce signals describing one or more features of the excavation site based on the position of the excavation vehicle within the excavation site. The controller is communicatively coupled to the first set of sensors, the second set of sensors, and the third set of sensors and is configured to enable the performance of an excavation operation based on the signals produced by the first set of sensors, second set of sensors, and the third set of sensors.

In an alternative embodiment, an excavation system is outfitted with a device which processes electronic signals from one or more sensors into hydraulic adjustments to enable actuation in an excavation vehicle. The device comprises a set of sensors configured to produce signals representative of 1) a position and orientation of an excavation tool of the excavation vehicle, 2) a position and orientation of the excavation vehicle within an excavation site, and 3) geographic features of the excavation site within a threshold distance of the excavation vehicle. The device further includes a set of solenoids. Each solenoid is configured to couple to a corresponding hydraulic valve of the excavation tool and to actuate the corresponding hydraulic valve. The device further includes a controller configured to couple to the set of solenoids and the excavation tool to perform an excavation routine by instructing the set of solenoids to actuate one or more corresponding hydraulic valves based on the signals produced by the sets of sensors.

The figures depict various embodiments of the presented invention for purposes of illustration only. One skilled in the art will readily recognize from the following discussion that alternative embodiments of the structures and methods illustrated herein may be employed without departing from the principles described herein.

DETAILED DESCRIPTION

I. Excavation System

Figure 1:
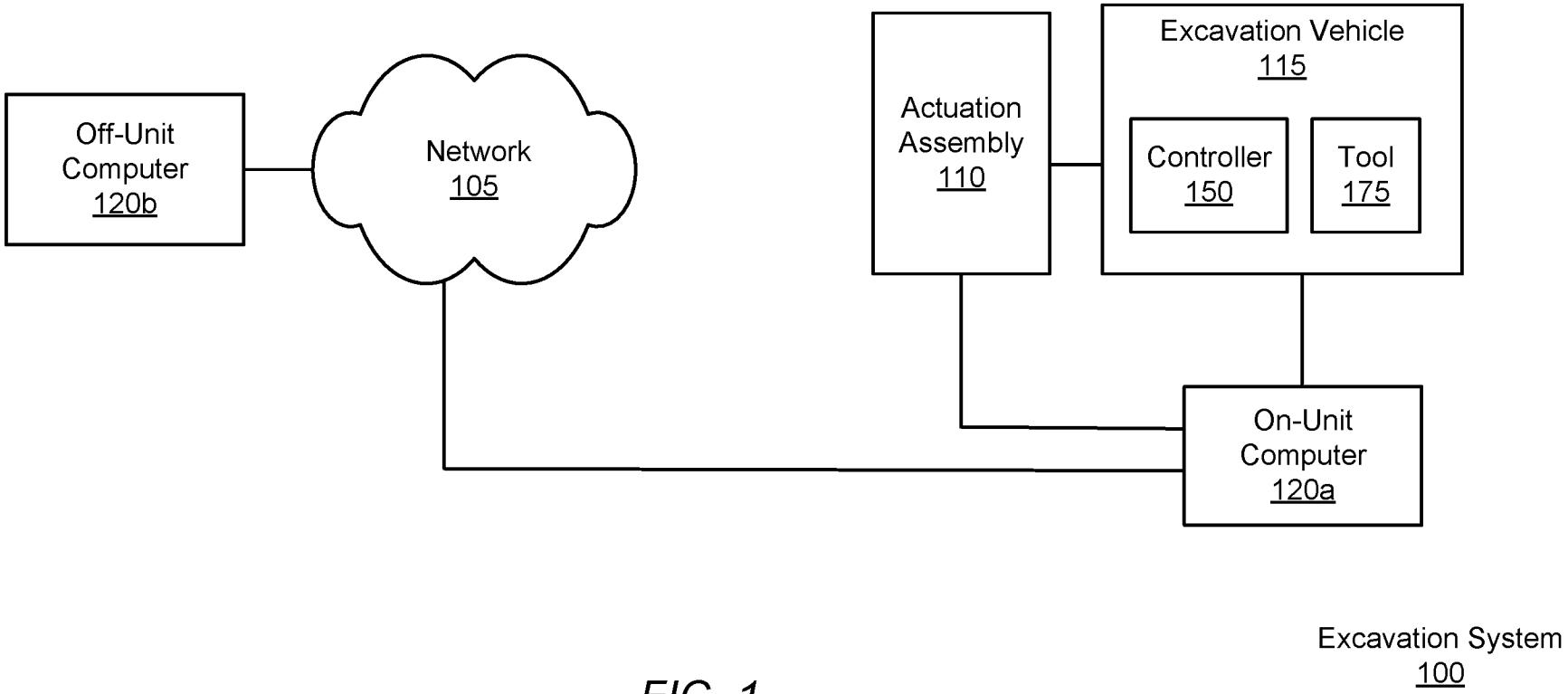
FIG. 1 shows an excavation system for excavating earth, according to an embodiment.

FIG. 1 shows an excavation system 100 for excavating earth autonomously or semi-autonomously from a dig site using a suite of one or more sensors 170 mounted on an excavation vehicle 115 to record data describing the state of the excavation vehicle 115 and the excavated site. As used herein, the term "autonomous" describes an excavation system enabled to actuate an excavation tool and navigate an excavation vehicle based on recorded sensor data.

The excavation system 100 includes a set of components physically coupled to the excavation vehicle 115. These components include an actuation assembly 110, the excavation vehicle 115 itself, a digital or analog electrical controller 150, an excavation tool 175, and an on-unit computer 120*a*.

In one embodiment, the sensor assembly includes one or more of any of the following types of sensors: measurement sensors, spatial sensors, vision sensors, and localization sensors 145.

Each of these components will be discussed further below in the remaining sub-sections of FIG. 1. Although FIG. 1 illustrates only a single instance of most of the components of the excavation system 100, in practice more than one of each component may be present and additional or fewer components may be used different than those described herein.

I.A. Excavation Vehicle

The excavation vehicle 115 is an item of heavy equipment designed to excavate earth from a hole within a dig site. Excavation vehicles 115 are typically large and capable of moving large volumes of earth at a single time, particularly relative to what an individual human can move by hand. As described herein, excavation refers generally to moving earth or materials within the site, for example to dig a hole, to fill a hole, to level a mound, or to deposit a volume of earth or materials from a first location to a second location. Materials, for example pieces of wood, metal, or concrete may be moved using a forklift, or other functionally similar machines. Generally, excavation vehicles 115 excavate earth by scraping or digging earth from beneath the ground surface. Examples of excavation vehicles 115 within the scope of this description include, but are not limited to loaders such as backhoe loaders, track loaders, wheel loaders, skid steer loaders, scrapers, graders, bulldozers, compactors, excavators, mini-excavators, trenchers, skip loaders.

Among other components, excavation vehicles 115 generally include a chassis 205, a drive system 210, an excavation tool 175, an engine (not shown), an on-board sensor assembly 110, and a controller 150. The chassis 205 is the frame upon on which all other components are physically mounted. The drive system 210 gives the excavation vehicle 115 mobility through the excavation site. The excavation tool 175 includes not only the instrument collecting earth, such as a bucket or shovel, but also any articulated elements for positioning the instrument for the collection, measurement, and dumping of dirt. For example, in an excavator or loader the excavation tool refers not only the bucket but also the multi-element arm that adjusts the position and orientation of the bucket.

The engine powers both the drive system 210 and the excavation tool 175. The engine may be an internal combustion engine, or an alternative power plant, such as an electric motor or battery. In many excavation vehicles 115, the engine powers the drive system 210 and the excavation tool commonly through a single hydraulic system, however other means of actuation may also be used. A common property of hydraulic systems used within excavation vehicles 115 is that the hydraulic capacity of the vehicle 115 is shared between the drive system 210 and the excavation tool. In some embodiments, the instructions and control logic for the excavation vehicle 115 to operate autonomously and semi-autonomously include instructions relating to determinations about how and under what circumstances to allocate the hydraulic capacity of the hydraulic system.

I.B. Actuation Assembly

As introduced above, the actuation assembly 110 may include a combination of one or more of: measurement sensors, for example end-effector sensors, vision sensors, and localization sensors. The sensor assembly 110 is configured to collect data related to the excavation vehicle 115 and environmental data surrounding the excavation vehicle 115. The controller 150 is configured to receive the data from the assembly 110 and to carry out the instructions of the excavation routine provided by the computers 120 based on the recorded data. This includes control the drive system 210 to move the position of the tool based on the environmental data, a location of the excavation vehicle 115, and the excavation routine. The actuation assembly is further described with reference to FIG. 3.

I.C. On-Unit Computer

Data collected by the sensors 170 is communicated to the on-unit computer 120*a* to assist in the design or carrying out of an excavation routine. Generally, excavation routines are sets of computer program instructions that, when executed control the various controllable inputs of the excavation vehicle 115 to carry out an excavation-related task. The controllable input of the excavation vehicle 115 may include the joystick controlling the drive system 210, the excavation tool, and any directly-controllable articulable elements, or some controller 150 associated input to those controllable elements, such as an analog or electrical circuit that responds to joystick inputs.

Generally, excavation-related tasks and excavation routines are broadly defined to include any task that can be feasibly carried out by an excavation routine. Examples include, but are not limited to: dig site preparation routines, digging routines, fill estimate routines, volume check routines, dump routines, wall cutback routines, backfill/compaction routines. In addition to instructions, excavation routines include data characterizing the site and the amount and locations of earth to be excavated. Examples of such data include, but are not limited to, a digital file, sensor data, a digital terrain model, and one or more tool paths.

The excavation vehicle 115 is designed to carry out the set of instructions of an excavation routine either entirely autonomously or semi-autonomously. Here, semi-autonomous refers to an excavation vehicle 115 that not only responds to the instructions but also to a manual operator. Manual operators of the excavation vehicle 115 may monitor the excavation routine from inside of the excavation vehicle 115 using the on-unit computer 120*a* or remotely using an off-unit computer 120*b* from outside of the excavation vehicle, another location on-site, or an off-site location. Manual operation may take the form of manual input to the joystick, for example. Sensor data is received by the on-unit computer 120*a* and assists in the carrying out of those instructions, for example by modifying exactly what inputs are provided to the controller 150 in order to achieve the instructions to be accomplished as part of the excavation routine. The excavation vehicle 115 may be operated semi-autonomously when a manual operator defines a target tool path or set of instructions for navigating through the dig site or performing an excavation routine, but the excavation vehicle 115 receives and executes the instructions without autonomously without further input from the user. In some embodiments, although the vehicle 115 may be configured to execute the received instructions autonomously, a manual operator may still be enabled to take over manual operation or control of the vehicle, for example via an on-board computer or an off-board computer.

The on-unit computer 120*a* may also exchange information with the off-unit computer 120*b* and/or other excavation vehicles (not shown) connected through network 105. For example, an excavation vehicle 115 may communicate data recorded by one excavation vehicle 115 to a fleet of additional excavation vehicles 115 that may be used at the same site. Similarly, through the network 105, the computers 120 may deliver data regarding a specific site to a central location from which the fleet of excavation vehicle 115*s* are stored. This may involve the excavation vehicle 115 exchanging data with the off-unit computer, which in turn can initiate a process to generate the set of instructions for excavating the earth and to deliver the instructions to another excavation vehicle 115. Similarly, the excavation vehicle 115 may also receive data sent by other sensor assemblies 110 of other excavation vehicles 115 as communicated between computers 120 over network 105.

The on-unit computer 120*a* may also process the data received from the sensor assembly 110. Processing generally takes sensor data that in a "raw" format may not be directly usable, and converts into a form that useful for another type of processing. For example, the on-unit computer 120*a* may fuse data from the various sensors into a real-time scan of the ground surface of the site around the excavation vehicle 115. This may comprise fusing the point clouds of various spatial sensors 130, the stitching of images from multiple vision sensors 135, and the registration of images and point clouds relative to each other or relative to data regarding an external reference frame as provided by localization sensors 145 or other data. Processing may also include up sampling, down sampling, interpolation, filtering, smoothing, or other related techniques.

I.D. Off-Unit Computer

The off-unit computer 120*b* includes a software architecture for supporting access and use of the excavation system 100 by many different excavation vehicles 115 through network 105, and thus at a high level can be generally characterized as a cloud-based system. Any operations or processing performed by the on-unit computer 120*a* may also be performed similarly by the off-unit computer 120*b*.

In some instances, the operation of the excavation vehicle 115 is monitored by a human operator. Human operators, when necessary, may halt or override the automated excavation process and manually operate the excavation vehicle 115 in response to observations made regarding the features or the properties of the site. Monitoring by a human operator may include remote oversight of the whole excavation routine or a portion of it. Human operation of the excavation vehicle 115 may also include manual control of the joysticks of the excavation vehicle 115 for portions of the excavation routine (i.e., preparation routine, digging routine, etc.). Additionally, when appropriate, human operators may override all or a part of the set of instructions and/or excavation routine carried out by the on-unit computer 120*a*. Manual operation of the excavation vehicle 115 may be performed remotely via a gamepad, joystick, computer, mouse, or another input device.

I.E. General Computer Structure

The on-unit 120*a* and off-unit 120*b* computers may be generic or special purpose computers. A simplified example of the components of an example computer according to one embodiment is illustrated in FIG. 2.

Figure 2:
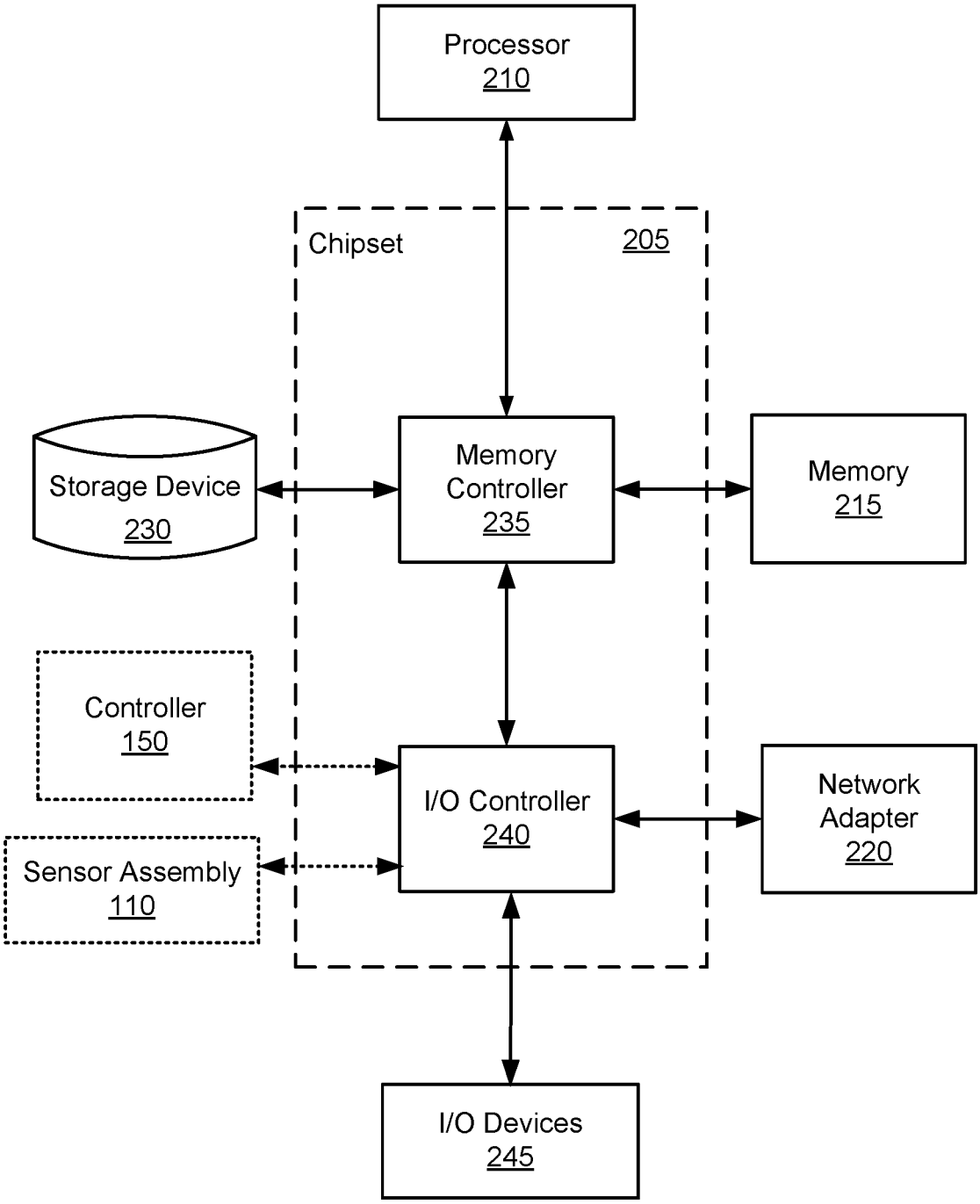
FIG. 2 is a high-level block diagram illustrating an example of a computing device using an on-unit or off-unit computer, and/or database server, according to an embodiment.

FIG. 2 is a high-level block diagram illustrating physical components of an example off-unit computer 120*b* from FIG. 1, according to one embodiment. Illustrated is a chipset 205 coupled to at least one processor 210. Coupled to the chipset 205 is volatile memory 215, a network adapter 220, an input/output (I/O) device(s) 225, and a storage device 230 representing a non-volatile memory. In one implementation, the functionality of the chipset 205 is provided by a memory controller 235 and an I/O controller 240. In another embodiment, the memory 215 is coupled directly to the processor 210 instead of the chipset 205. In some embodiments, memory 215 includes high-speed random access memory (RAM), such as DRAM, SRAM, DDR RAM or other random access solid state memory devices.

The storage device 230 is any non-transitory computer-readable storage medium, such as a hard drive, compact disk read-only memory (CD-ROM), DVD, or a solid-state memory device. The memory 215 holds instructions and data used by the processor 210. The I/O controller 240 is coupled to receive input from the machine controller 250 and the sensor assembly 210, as described in FIG. 1, and displays data using the I/O devices 245. The I/O device 245 may be a touch input surface (capacitive or otherwise), a mouse, track ball, or other type of pointing device, a keyboard, or another form of input device. The network adapter 220 couples the off-unit computer 120*b* to the network 105.

As is known in the art, a computer 120 can have different and/or other components than those shown in FIG. 2. In addition, the computer 120 can lack certain illustrated components. In one embodiment, a computer 120 acting as server may lack a dedicated I/O device 245. Moreover, the storage device 230 can be local and/or remote from the computer 120 (such as embodied within a storage area network (SAN)), and, in one embodiment, the storage device 230 is not a CD-ROM device or a DVD device.

Generally, the exact physical components used in the on-unit 120*a* and off-unit 120*b* computers will vary. For example, the on-unit computer 120*a* will be communicatively coupled to the controller 150 and sensor assembly 110 differently than the off-unit computer 120*b*.

Typically, the on-unit computer 120*a* will be a server class system that uses powerful processors, large memory, and faster network components compared to the on-unit computer 120*b* because the on-unit computer 120*a* controls individual sensors, for example vision sensors used for pedestrian detection, however this is not necessarily the case. Such a server computer typically has large secondary storage, for example, using a RAID (redundant array of independent disks) array and/or by establishing a relationship with an independent content delivery network (CDN) contracted to store, exchange and transmit data such as the asthma notifications contemplated above. Additionally, the computing system includes an operating system, for example, a UNIX operating system, LINUX operating system, or a WINDOWS operating system. The operating system manages the hardware and software resources of the off-unit computer 120*b* and also provides various services, for example, process management, input/output of data, management of peripheral devices, and so on. The operating system provides various functions for managing files stored on a device, for example, creating a new file, moving or copying files, transferring files to a remote system, and so on. In some embodiments, data recorded and processed by components of excavation vehicle 115 and the actuation assembly 110 are stored on a cloud server.

As is known in the art, the computer 120 is adapted to execute computer program modules for providing functionality described herein. A module can be implemented in hardware, firmware, and/or software. In one embodiment, program modules are stored on the storage device 330, loaded into the memory 315, and executed by the processor 310.

I.F. Network

The network 105 represents the various wired and wireless communication pathways between the computers 120, the sensor assembly 110, and the excavation vehicle 115. Network 105 uses standard Internet communications technologies and/or protocols. Thus, the network 105 can include links using technologies such as Ethernet, IEEE 802.11, integrated services digital network (ISDN), asynchronous transfer mode (ATM), etc. Similarly, the networking protocols used on the network 150 can include the transmission control protocol/Internet protocol (TCP/IP), the hypertext transport protocol (HTTP), the simple mail transfer protocol (SMTP), the file transfer protocol (FTP), etc. The data exchanged over the network 105F can be represented using technologies and/or formats including the hypertext markup language (HTML), the extensible markup language (XML), etc. In addition, all or some links can be encrypted using conventional encryption technologies such as the secure sockets layer (SSL), Secure HTTP (HTTPS) and/or virtual private networks (VPNs). In another embodiment, the entities can use custom and/or dedicated data communications technologies instead of, or in addition to, the ones described above.

II. Electronic Actuation of an Excavation Vehicle

II.A Sensor Data and Signal Processing

An excavation vehicle 115 is configured to navigate within a site to perform one or more excavation routines (or "excavation routines" hereinafter). For example, in implementations in which the excavation vehicle 115 is implemented to excavate earth from a dig site, the actuation assembly adjusts an excavation tool to a depth beneath the ground surface and to a depth above the ground surface in order to remove earth from the hole. The actuation assembly 300 may additionally instruct the drivetrain on which the excavation tool is mounted to navigate the vehicle 115 over the area of the hole or from the hole to a dump pile to deposit the excavated earth. In alternate embodiments, the actuation assembly 300 may actuate an excavation tool to remove obstacles within a site, for example by breaking the obstacle to a size which the vehicle 115 can maneuver or adjusting earth within the site to remove the obstacle.

Figure 3A:
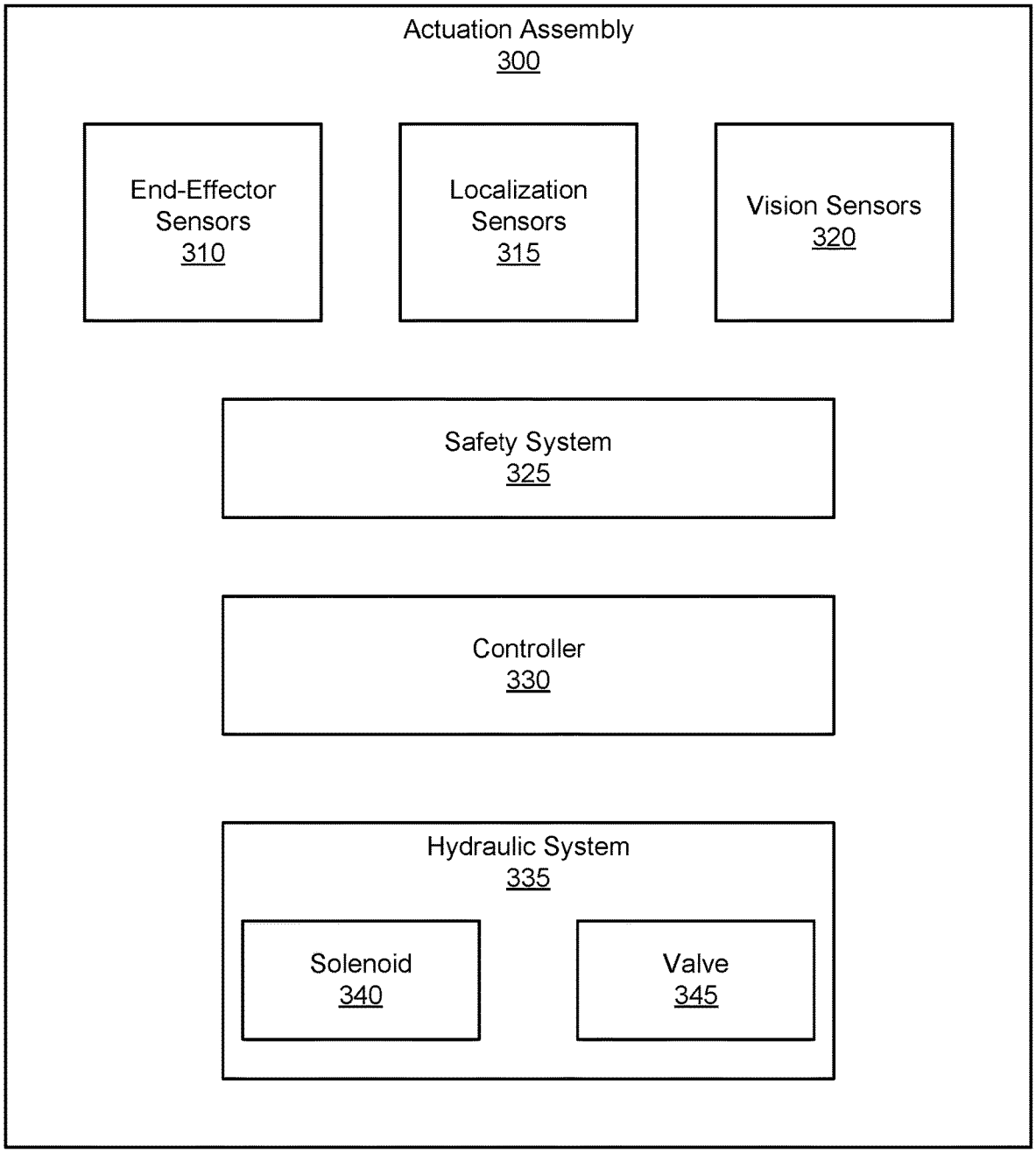
FIG. 3A is a diagram of the architecture of the actuation assembly, according to an embodiment.

FIG. 3A is a diagram of the architecture for the actuation assembly 300, according to an embodiment. The actuation assembly enables an excavation system to actuate an excavation tool mounted to an excavation vehicle as well as the excavation vehicle 115 in order to execute an excavation routine. The actuation assembly 300 is one embodiment of the actuation assembly 110. The architecture of the actuation assembly 300 comprises end-effector sensors 310, localization sensors 315, vision sensors 320, a safety system 325, and a controller 330. In embodiments in which the excavation vehicle is actuated using hydraulic components, the actuation assembly further comprises a hydraulic system 335 which includes at least one solenoid 340 and at least one corresponding valve 345. In other embodiments, the actuation assembly 300 may include more or fewer modules. Functionality, indicated as being performed by a particular module may be performed by other modules instead.

Although actuation assembly is described herein in the context of an excavator performing an excavation routine, one skilled in the art would understand that the actuation assembly as described could be coupled to any vehicle 115 deployed in a site to perform a routine requiring actuation of one or more components. Communications performed wirelessly include, but are not limited to, 2.4/5 GHz Wi-Fi, cellular, LTE, Bluetooth, 900 MHz radio, or satellite communications. In one embodiment, end-effector sensors 310, localization sensors 315, and vision sensors 320 are mounted to the excavation vehicle 115 or the excavation tool 175 using existing fastening features on the excavation vehicle, for example threaded fasteners, such that the structure of the vehicle 115 need not be modified. In another embodiment, end-effector sensors 310, localization sensors 315, and vision sensors 320 are mounted to the excavation vehicle 115 or the excavation tool 175 by modifying the structure of the vehicle 115 or by designing a custom fastening feature by which the sensors may be mounted of the vehicle 115.

Although not shown, electronic components of the actuation assembly, and more generally of the excavation vehicle 115, may be powered by machine batteries or separate batteries provided by a manual operator. In some embodiments, an uninterruptible power supply may be used as a temporary backup system if the machine battery or a separate battery fails or if the engine stalls during ignition. The action assembly 300 may implement power converters to convert voltages from the batteries to different electronic inputs. Power within the system may be distributed from a central bus bar or from multiple points and a switch may be used to direct power from the batteries to the electronics.

In one embodiment, the end-effector sensors 310 include at least one inertial measurement unit or a similar sensor configured to couple to the machine base and each independent joint of the excavation tool. For example, an end-effector sensor is coupled at each joint at which the excavation tool experiences a change in angle relative to the ground surface, a change in height relative to the ground surface, or both. Based on recorded data, the end-effector sensors 310 produce a signal representative of a position and orientation of the corresponding joint relative to an excavation site. The produced signal is processed by a controller, for example the controller 330, to determine the orientation and/or position of the excavation tool and the excavation vehicle 175. Data gathered by end-effector sensors 310 may also be used to determine derivatives of position information.

In one embodiment, the localization sensors 315 comprise at least one transmitter/receiver pair, one of which is mounted to the excavation vehicle and the other is positioned away from the vehicle 115, for example a GPS satellite. In implementations in which a computer 120 determines a position of features or obstacles within a dig site relative to the position of the excavation vehicle 115, the localization sensors 315 comprise a single transmitter/receiver pair mounted to the excavation vehicle 15. Based on recorded data, the localization sensors 315 produce a signal representative of the position and orientation of the excavation vehicle relative to the excavation site. The produced signal is processed by the controller 330.

The vision sensors 320 comprise a plurality of sensors configured to record a field of view in all directions that the machine is capable of moving. In one embodiment, the vision sensors 320 include LIDAR sensors, radar sensors, cameras, an alternative imaging sensor, or a combination thereof. The actuation assembly 300 may include a second set of vision sensors 320 configured to record the interaction of the excavation vehicle 115 with features within the environment, for example excavating earth from a hole, depositing earth at a dump pile, or navigating over a target tool path to excavate earth from a hole. Based on the recorded data, the vision sensors 320 produce at least one signal describing one or more features of the excavation site based on the position of the excavation vehicle 115 within the excavation site. The produced signal is processed by the controller 330.

Under certain conditions, the safety system 325 is activated causing the excavation vehicle 115 to halt actuation of one or more components of the excavation vehicle 115. For example, sensor data collected by the vision sensors 320 may indicate that an obstacle obstructs a path over which the vehicle 115 is navigating, the safety system generates a signal instructing the excavation vehicle 115 to stop actuation of the drivetrain. Accordingly, the safety system 325 may comprise an emergency stop button which communicate with the vehicle 115 or the tool 175 using a wired connection, a wireless connection, or a combination of the two. A wired emergency stop button may be connected directly to the ignition of the excavation vehicle 115. In embodiments in which the emergency stop button is wired, the button can only be triggered by a manual operator, for example by pressing the button. In such embodiments, the wired button communicates based on an independent circuit or software from a wireless emergency stop button. Although described herein as potentially being a "button," the emergency stop button may be triggered without input from a human operator, but rather as an autonomous response to sensor data gathered by the end-effector sensors 310, localization sensors 315, vision sensors 320, or a combination thereof.

As described above, the controller 330 produces actuating signals to control the joints of the excavation tool to autonomously perform an excavation routine based on the signals produced by the end-effector sensors 310, localization sensors 315, and vision sensors 320. In some embodiments, while processing signals recorded by the sensors 310, 315, and 320, the controller 330 identifies one or more stop conditions, or conditions that would prevent the actuation of the excavation vehicle 115. Additionally, any identified stop conditions may trigger the safety system 325 to activate.

The actuating signals generated by the controller 330 may also be referred to as a tool path, or a set of instructions which guide the excavation tool 175 to excavate a volume of earth as a part of an excavation routine, remove obstacles obstructed in the navigation of the excavation vehicle 115, release contents onto a dump pile, or some combination thereof. In some embodiments in which a tool path is generated prior to deployment of the excavation vehicle 115 in the site, the controller 330 receives a previously generated tool path.

Generally, a tool path provides geographical steps and corresponding coordinates for the excavation vehicle 115 and/or excavation tool to traverse within a site, for example a route to circumvent an obstacle or a route between a hole and a dump pile. In addition, tool paths describe actions performed by the excavation tool mounted to the excavation vehicle 115, for example adjustments in the position of the tool at different heights above the ground surface and depths below the ground surface. When the site 505 is represented in the digital terrain model as a coordinate space, for example as described above, a tool path includes a set of coordinates within the coordinate space. When a set of instructions call for the excavation vehicle 115 to adjust the tool mounted to the excavation vehicle 115 to excavate earth, dump earth, break down an obstacle, or execute another task the tool path also includes a set of coordinates describing the height, position, and orientation of the tool within the coordinate space of the site 505. For holes of greater volumes or requiring a graded excavation, multiple tool paths may be implemented at different offsets from the finish tool path.

Tool paths are defined based on several factors including, but not limited to, the composition of the soil, the properties of the tool being used to excavate the hole, the properties of the drive system 210 moving the tool, and the properties of the excavation vehicle 115. Example properties of the excavation tool 175 and excavation vehicle 115 include the size of the tool, the weight of the excavation tool, and the force exerted on the excavation tool 175 in contact with the ground surface of the site.

Some tool paths achieve goals other than digging. For example, the last tool path used at the conclusion of the excavation of the hole may be referred to as a finish tool path, which digs minimal to no volume and which is used merely to even the surface of the bottom of the dug hole. While moving through the finish tool path, the tool excavates less earth from the hole than in previous tool paths by adjusting the depth of the leading edge or the angle of the tool beneath the ground surface. To conclude the digging routine, the excavation vehicle 115 adjusts a non-leading edge of the tool and reduces the speed of the drive.

As described above, the hydraulic system 335 comprises a solenoid 340 and a valve 345. In other embodiments, the hydraulic system 335 may include more or fewer modules. Functionality, indicated as being performed by a particular module may be performed by other modules instead. As described below, the controller 330 receives signals from a combination of the end-effectors sensors 310, localization sensors 315, and vision sensors 320. In some embodiments, the controller 330 is additionally coupled to a set of solenoids, each of which is further coupled to a corresponding hydraulic valve of the excavation tool. The controller 330 processes signals received from the sensors 310, 315, and 320 which instruct one or more solenoids to actuate a corresponding hydraulic valve, thereby navigating the excavation vehicle 115 or actuating the tool 175.

Figure 3B:
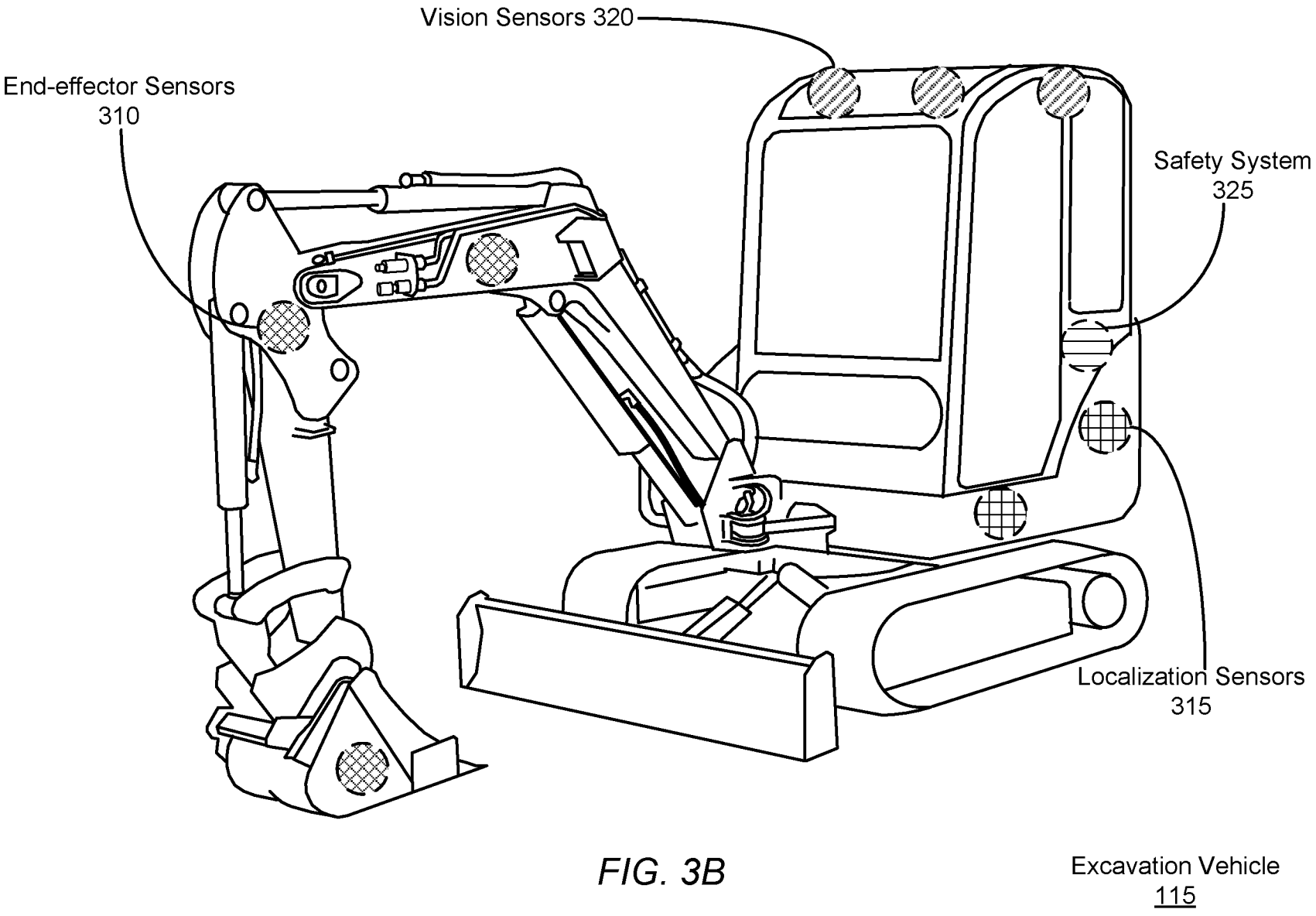
FIG. 3B illustrates an example placement of sensors on an excavator, according to an embodiment.

FIG. 3B illustrates an example placement of sensors for an excavator, according to an embodiment. In the embodiment illustrated in FIG. 3B, end-effector sensors 310 are represented as circles with diagonal cross-hatching. As described above, the end-effector sensors 310 are mounted to the excavation too, the excavator, to generate signals describing the position and orientation of the tool. Localization sensors 315 are illustrated as circles with perpendicular cross-hatchings. The localization sensors 315 are mounted to the base of the excavation vehicle 115 to track the position and orientation of vehicle 115 independent of the movement of the tool. The vision sensors 320 are illustrated as circles with diagonal lines. The vision sensors 320 are mounted to the roof of the vehicle 115 such that each sensor has an unobstructed view of the area surrounding the excavation vehicle and the excavation tool. The safety system 325 is illustrated as a circle with horizontal lines mounted to the exterior of the vehicle 115, but in alternate embodiments, the safety system 325 may also be mounted in the interior of the cab of the excavation vehicle 115. The components of the actuation assembly 300 may be mounted in a variety of different positions on the excavation vehicle 115 than those illustrated in FIG. 3B while preserving the functionality of each component as described above.

Figure 4:
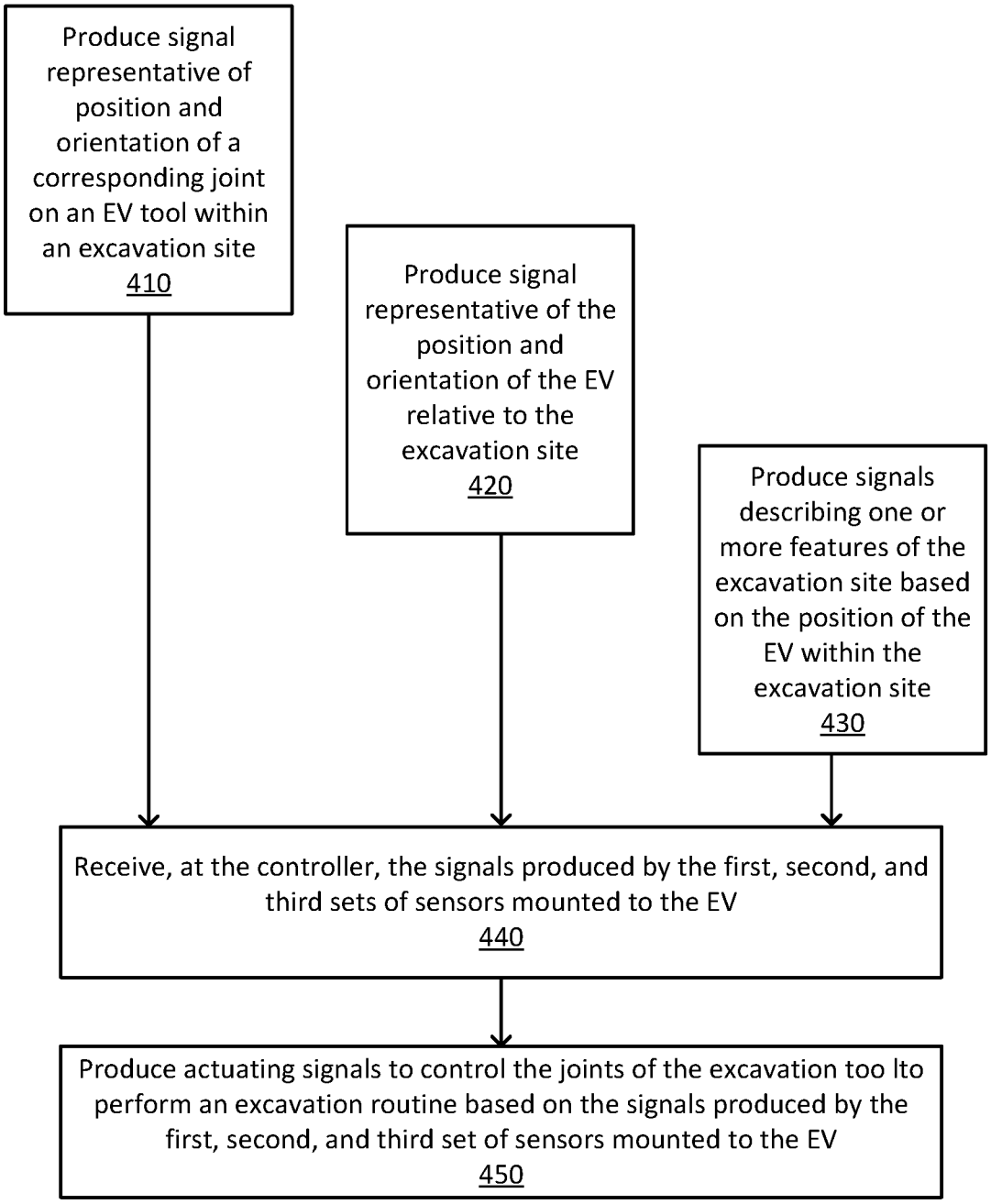
FIG. 4 shows an example flowchart describing the process for electronically actuating an excavation vehicle, according to an embodiment.

To implement the system architecture of the actuation assembly 300, FIG. 4 shows an example flowchart describing the process for electronically actuating an excavation vehicle, according to an embodiment. As described above, an excavation vehicle is positioned within a site, surrounded by features of the site (e.g., an initial terrain of the site or obstacles within the site), a dump pile, and a hole to be excavated. To characterize the position of an excavation tool within the site or relative to other features of the site, the actuation assembly 300 produces 410 signals representative of the position and orientation of individual joints on an excavation tool 175 within an excavation site. For example, signals indicating a sequence of joints positioned in an ascending order may indicate that a tool is oriented upwards above the ground surface. In comparison, signals indicating a sequence of joints positioned in a descending order may indicate that a tool is oriented downwards below the ground surface.

The actuation assembly 300 additionally produces 420 a signal representative of the position and orientation of the excavation vehicle 115 relative to the excavation site. For example, the signal indicates that the excavation vehicle is positioned 20 meters away from the dump pile and oriented away from the dump pile. The actuation assembly 300 may also produce 430 signals describing one or more features of the excavation site based on the position of the excavation vehicle 115 within the site. For example, the actuation assembly 300 may identify a body of water which the excavation vehicle 115 cannot navigate over, but rather must navigate around.

The actuation assembly 300 receives 440 the signals produced by the sensors 310, 315, and 320 and produces 450 actuating signals to control the joints of the excavation tool to perform an excavation routine based on the produced signals. For example, signals produced by the end-effector sensor 310 may indicate that the tool 175 is positioned above the ground surface. Accordingly, to perform an excavation routine, the actuation assembly 300 may generate a target tool path including instructions to actuate the excavation tool to move below the ground surface. As another example, signals produced by the localization sensor 315 may indicate that the vehicle 115 is positioned near the dump pile rather than the hole. Accordingly, to perform an excavation routine, the actuation assembly 300 may generate a target tool path to navigate the excavation vehicle 115 to drive towards the hole. Returning to the example described above involving the body of water, the actuation assembly 300 may generate an updated target tool path including instructions to navigate the excavation vehicle 115 around the body of water based on signals produced by the vision sensor 320.

II.C Actuation—Additional Components

In conventional systems which rely on inputs from human operators, the computer 120 generates two types of signals: 1) a binary switch either turning the machine on or off and 2) a set of controls with continuous ranges of readings, for example a PWM signal, a digital CAN signal, an analog signal, a bus communication signal, or variable resistance signals. In such systems, human operators manipulate the actuation of the excavation tool 175 or vehicle 115 using an input device, for example a physical switch, joystick, or touch screen interface. In comparison, the actuation assembly 300 produces actuating signals by producing signals that mimic those produced during manual operation.

The actuation assembly 300 may further include several components (not shown) further includes an optional master switch to activate all electronic components of excavation vehicle 115 including components of the actuation assembly. In some embodiments, activation of the master switch is required for both manual and autonomous operation of the excavation vehicle 115. In alternate embodiments, activation of the master switch may only activate components required for autonomous actuation. Additionally, the actuation assembly 300 may further include an operation settings switch which allows an excavation vehicle 115 to be operated either manually or autonomously. For example, the operation settings switch may be initially set to allow the vehicle 115 to operate autonomously, but settings may be updated for the vehicle to be operated manually at the best of an operator overseeing the job. In alternate embodiments, electronic relays may be implemented to structurally replace the switches while mimicking the functionality of the switches. In such embodiments, when power is not supplied to one or more relays, the vehicle 115 may be operated manually, but in response to supplying power to the relays, the vehicle 115 may operate autonomously. In yet another embodiment, the actuation assembly 300 may include a combination of binary switches, electronic relays, and one or more onboard or offboard computers to control other components of the actuation assembly 310.

The actuation assembly 300 may additionally include one or more microcontrollers to produce PWM or CAN signals to drive a switch associated with the joints of an excavation tool 175 by matching the frequency and duty cycle of the machine controls. The microcontrollers may alternatively produce other digital communication protocols. In embodiments mimicking variable resistance machine control signals, the actuation assembly may implement one or more resistors or potentiometers.

When configuring of the actuation assembly 300, components may be mounted at any number of locations on the excavation tool 175. For example, components may be coupled at a central location on the vehicle 115, or at each electrical connection, or a combination thereof. In some embodiments, electronic components may be mounted to the excavation vehicle on an instrument deck that is housed in a weatherproof encasing to protect assembly 300 from severe weather conditions, for example heat, dust, ice, and water. The instrument deck may be mechanically isolated from the machine by one or more of the following: springs, shock absorbers, or other vibration isolation methods. In some embodiments, electronic components may be mounted to the excavation vehicle on an instrument deck that is housed in the weatherproof container. The instrument deck may be mechanically isolated from the machine by one or more of the following: springs, shock absorbers, or other vibration isolation methods.

In some configurations, the encasing may be designed to cool electronic components. In such configurations, the encasing may include one or more fans, blowers, or alternative active cooling systems. Alternatively, the encasing may include a passive cooling system, for example a heatsink fan. The encasing may also include tubing for ducting air conditioning from the cab of the excavation vehicle 115 to components requiring cooling. Some configurations include individual components or a combination of the components listed above, for example a configuration implementing heatsink fins to conduct heat away from hot components and a fan to then blow air across the heatsink fins. As another example, a fan or blower may be used to increase the air pressure coming from the machine air conditioning unit. Enclosures for components within the casing may be coated or painted in a manner that decreases the solar absorptivity of the material to limit temperature risk due to the exposure to sunlight or other UV radiation. Cooling components may be connected to the vehicles onboard power systems (i.e., a battery) or be optionally controlled by the onboard electronics (i.e., relays or the computer 120). Cooling components and the weatherproof encasing are mounted to the excavation vehicle 115 as to not impede the functionality of the vehicle 115 of the tool 175. In some embodiments, the computer 120 may read relevant air or component temperatures to determine whether or not the cooling system should be activated, at what level it should be activated, and if it is functioning properly.

Electrical connections to the controller 330 are made such that the machine signal produced by the controller 330 are communicated to the computer 120 responsible for actuating the excavation tool 175. In some embodiments, the vehicle 175 may be outfitted with new wiring to communicate the signal, but in other embodiments, the existing wired connections may be tapped into along a signal path to communicate the signal. Accordingly, an off-unit or on-unit computer 120 may be used to control all actuating signals generated by the controller 330. "Tapping into" as referred to herein refers to circuit design techniques in which existing or similar connectors, soldered connections, or other physical electronic connections are added to an existing set of wiring.

In some embodiments, the computer 120 may implement a feedback loop between the localization system to send signals to control the machine. By observing other systems within the excavation vehicle 115 to characterize a distribution of hydraulic pressure, the computer 120 may adjust the distribution of hydraulic pressure from those systems to accommodate the actuation of the excavation tool 175 of the excavation vehicle 115. In doing so, the computer 120 also receives and process signals produced by controllers associated with each of those systems in addition to the actuation signals produced by the controller of the actuation assembly 300.

II.C End-Effector Sensors

In addition to the description above, end-effector sensors 310 may include, but are not limited to, incline sensors, gyroscopes, accelerometers, string potentiometers, strain gauges, rotary joint encoders, linear hydraulic cylinder encoders ultrasonic distance sensors, laser distance and plane/elevation sensors, fiducial-based motion capture systems, and non-fiducial pose estimates determined using computer vision. In addition to the configurations in which end-effector sensors 310 are coupled to each joint on the excavation tool 175, end-effector sensors may be mounted at a variety of alternate positions on the excavation vehicle 115. In configurations involving end-effector sensors 310, the sensors 310 are coupled to the tool 175 or another end-effector such that the coupling does not impede movement, motion, or function of the end effector and function of the sensor. In implementations using a plurality of sensors 310, the sensors may produce a signal based on a vector generated to understand the orientation of the excavation tool 175. The plurality of end-effector sensors 310 may further be configured to record different combinations of data that are useful.

As described above in Section II.B, signals produced by the end-effector sensors 310 are communicated to the controller 330 via either a wired or wireless communication. The controller processes the signal generated by the sensors 310 which contains position and orientation information regarding the tool 175 relative to either the base of the excavation vehicle 115 or a feature of the surrounding environment within the site, for example the ground surface or an object within the site. In some embodiments, such signal communication and processing is a closed loop control system. A combination of a larger number of sensors generates improved sensor data, feedback, and actuation control signals. In some embodiments, the actuation assembly 310 implements the controller 330 to proactively or reactively plan movement or actuation of the end-effector.

In one implementation, the absolute position of the excavation vehicle 115 within the coordinate space is measured using one or more global positioning sensors mounted on the tool. To determine the position of the tool in a three-dimensional coordinate space relative to the excavation vehicle, the controller 330 accesses additional information recorded by the sensors 310. In addition to the absolute position of the excavation vehicle 115 measured using the global positioning sensor, the controller 330 performs a forward kinematic analysis on the tool and maneuvering unit of the excavation vehicle 115 to measure the height of the tool relative to the ground surface. Further, one or more additional end-effector sensors 310 mounted on tool measure the orientation of a leading edge of the tool relative to the ground surface. The leading edge describes the edge of the tool that makes contact with the ground surface. The controller 330 accesses a lookup table and uses the absolute position of the excavation vehicle 115, the height of the tool, and the orientation of the leading edge of the tool as inputs to determine the position of the tool relative to the excavation vehicle 115.

II.D Localization Sensors

The actuation assembly 300 may determine the position and orientation of the excavation vehicle 115 based on locations which are both known and unknown to the controller 330. Signals produced by the localization sensors 315 are communicated to the controller 330 via either a wired or wireless communication. Based on the signals produced by localization sensors 315, the controller 330 may perform kinematics using machine dimensions and incline sensors to determine the location of the end-effectors and any relevant linkages relative to the position of the base of the excavation vehicle 115. Such kinematic analysis may also rely on signals describing the roll, pitch, and yaw of end-effector sensors. The controller 330 may also implement algorithms to determine position information describing the vehicle 115 including, but not limited to, GPS algorithms, simultaneous localization and mapping techniques, and kinematic algorithms.

In embodiments in which a starting point for the vehicle 115 is unknown, the localization sensors 315 implement a positioning system of transmitters and receivers. By using known positions of the transmitters and/or receivers and their positions relative to the excavation vehicle 115, the localization sensors 315 can determine the position and orientation of the excavation vehicle 115 within the site. Examples of such a positioning system include, but are not limited to, a satellite system such as a global positioning system, a regional line of sight system, or a local positioning system. In some embodiments, the localization sensors 315 may implement two roving sensors to determine the position and orientation of the excavation vehicle 115.

In implementations in which the starting position of the excavation vehicle 115 is known, the localization sensors 315 access the known starting location of the vehicle 115 or the starting location relative to an object within the site. Such localization sensors coupled to the excavation vehicle 115 include, but are not limited to, speedometers, incline sensors, accelerometers, or an alternate means of measuring the rotational velocity of tracks, wheels, drums, or another measurement of the relative ground speed of a vehicle. In such implementations, the localization sensors 315 localize the vehicle 115 without communicating with hardware external to the vehicle 115. An exemplary system which may be used in such environments or circumstances where a positioning system such as a global positioning system is unavailable.

Structurally, localization sensors 315 are coupled to the base of the excavation vehicle 115 at a position independent of the excavation tool 175. The location at which each sensor 315 is coupled does not impeded impede movement, motion, or function of the excavation vehicle 115 and function of the sensors 315. For example, in configurations in which the localization sensors 315 are satellite positioning systems such as GPS, the sensors 315 are coupled at locations with an unobstructed line of sight to the sky.

As the excavation vehicle 115 navigates within the site 505, the position and orientation of the vehicle and tool are dynamically updated within the coordinate space representation maintained by the computer 120. Using the information continuously recorded by the sensors 170, the computer 120 records the progress of the excavation tool path or route being followed by the excavation vehicle in real-time, while also updating the instructions to be executed by the controller. To determine the position of tool within the three-dimensional coordinate space, the controller 330 may use the sensors 315 to correlate changes in the information recorded by the sensors with the position of the tool in the coordinate space by referencing a parametric model or lookup table. Lookup tables are generated by measuring the output of sensors at various positions of the tool and correlating the outputs of the sensors with the positions of the tool.

II.E Vision Sensors

The actuation assembly 310 may implement vision sensors 320 to characterize the environment surrounding the excavation vehicle 115 before generating signals. In addition to those described above, vision sensors 320 include, but are not limited to, LIDAR cameras, radar sensors, RGB cameras, stereocameras, and thermal cameras to identify obstacles above the ground surface. In some embodiments, vision sensors 320 may comprise a combination of sensors for detecting objects above ground as well as underground to allow the controller 330 to generate complete and efficient tool paths for the excavation vehicle 115 to follow. Vision sensors 320 used to identify obstacles beneath the ground surface, include, but are not limited to, ground penetrating radar sensors, magnetic resonance imaging techniques, and x-ray cameras.

Structurally, each vision sensors 320 is coupled to the excavation vehicle 115 at a position with an unobstructed field of view of each region, for which the sensors 320 are responsible for observing. Vision sensors 320 may be coupled to both manually and autonomously actuated structures such that the region within the field of view of each sensor is dynamic.

Data recorded by vision sensors 320 may also be used in conjunction with data describing the known positions of obstacles within a field. Signals produced by the vision sensors 320 are communicated to the controller 330 via either a wired or wireless communication. The controller 330 may implement computer vision algorithms, for example machine learning or neural networks, to determine whether an object is an obstacle. In some embodiments, the controller 330 may aggregate data recorded by the vision sensors 320 using sensor fusion techniques or filters to combine data from multiple sensor types. For example, the controller 330 may classify dirt or other material based on signals received from multiple vision sensors 320.

In some embodiments, the controller 330 aggregates data recorded by vision sensors 320, for example GPS or alternate positioning systems, into one or more terrain maps describing the environment over which excavation vehicle 115 has traveled. Terrain maps may also be defined using a "site mesh" representation created before the execution of the excavation routine on a handheld device, stationary device, CAD program, or functionally similar device. A site mesh is a three-dimensional representation of the current state of the area and/or the desired state of the area. In such implementations, the controller 330 may also rely on data recorded by a combination of sensors including, end-effector sensors 310, speedometers for measuring resistance to tracks, wheels, the tool 175, engine RPM, or other systems, pressure sensors for determining soil type, vision system sensors as described above. The controller 330 may further analyze data recorded by ground penetrating systems to detect and determine the composition of earth under the machine or to identify obstacles or objects underneath the ground surface. The controller 330 may be implement a combination of the types of sensors described above. The controller may use a combination of machine data, such as engine RPM, track or wheel speed, end-effector speed, in combination with sensor outputs to make observations of the terrain for greater insight and accuracy in the terrain map.

As described above, while navigating within the site or a hole, the vision sensors 320 may detect an obstacle obstructing the tool path over which the excavation vehicle is traveling. To move past an obstacle, the excavation vehicle may either travel around the obstacle or execute a set of instructions to remove the obstacle before traveling through it. Depending on the type of obstacle detected, the excavation vehicle may redistribute earth from various locations in the site to level, fill, or modify obstacles throughout the site. In some implementations, the excavation vehicle 115 moves the physical obstacle, for example a shrub, to a location away from the path of the vehicle. Obstacles may obstruct the movement of the excavation vehicle 115 around the site 505 and within the hole 540 during an excavation tool path. Accordingly, the controller 330 generates routes for traveling between locations of the site based on the locations of obstacles, the hole, and a dump pile. More specifically, prior to moving between two locations within the site, the controller 330 uses information gathered by the sensors 320 and presented in digital terrain models to determine the most efficient route between the two locations in the site. By generating these routes prior to navigating within the site, the excavation vehicle is able to more efficiently navigate within the site and execute excavation tool paths within the site.

II.F Safety System

As described above, the safety system 325 is a mechanism, which when triggered by instructions from the controller 330, halts one or more processes occurring within the excavation vehicle 115, for example actuation of the excavation tool 175. In some embodiments, the safety system 325 comprises one or more of the following: indicator lights, audible alerts, object detection hardware and software, a wireless remote control, one or more wireless remote emergency stop buttons, and one or more hard-wired emergency stop buttons. In implementations in which a manual operator supervises an excavation routine, indicator lights and audible alerts may alter a manual operator to active the safety system either by a wireless remote control, a wireless remote emergency stop button, or a hard-wired emergency stop button. In implementations in which the excavation vehicle 115 operates autonomously, the safety system 325 may be triggered regardless of the indicator lights and audible alerts based on a signal received from the controller 330.

In some embodiments, a safety system 325 comprises a wireless remote emergency stop button and a hard-wired emergency stop button are connected to the same circuit which is connected directly to the machine power system. The resulting circuit creates a redundant/master safety circuit which controls the safety system 325. For example, if one component in the safety system 325 is triggered, power directed to all systems in the excavation vehicle 115 is shut down. Hard-wired emergency stop buttons are mounted in safe locations on the excavation vehicle 115 that are physically and easily accessible by a manual operator and out of range of the tool 175.

In embodiments in which the safety system 325 implements circuits involving relays or switches, the circuits operate on a "normally closed circuit," or a circuit that transmits through the switch to the receiving computer in a typical operating state. In such circuits, when a hard-wired emergency stop button is engaged, the button cuts the signal and triggers the system to deactivate the machine. In alternate embodiments, a watch dog timer is used to detect and recover from communications and computer hardware malfunctions. During normal operation, the computer 120 will regularly reset the watchdog timer to prevent the timer from expiring. If there is a malfunction with the computer 120, and the watchdog timer expires, the safety system 325 will trigger the excavation vehicle 115 to halt its operation until a corrective action has been taken. When halted under such conditions, the vehicle 115 is referred to as in "safe-state." Accordingly, the vehicle 115 is put into safe-state when there is a communication or hardware malfunction on the remote monitoring computer or embedded system. Similar, to the watchdog timer, the wireless emergency stop button implements a "heartbeat" such that the receiver system on the vehicle 115 must receive a signal from the wireless emergency stop button at set intervals. If the receiver missed a predetermined number of "heartbeats," the safety system triggers and the machine halts operation as if the wireless emergency stop button was engaged.

III. Hydraulic Actuation of an Excavation Vehicle

Figure 5:
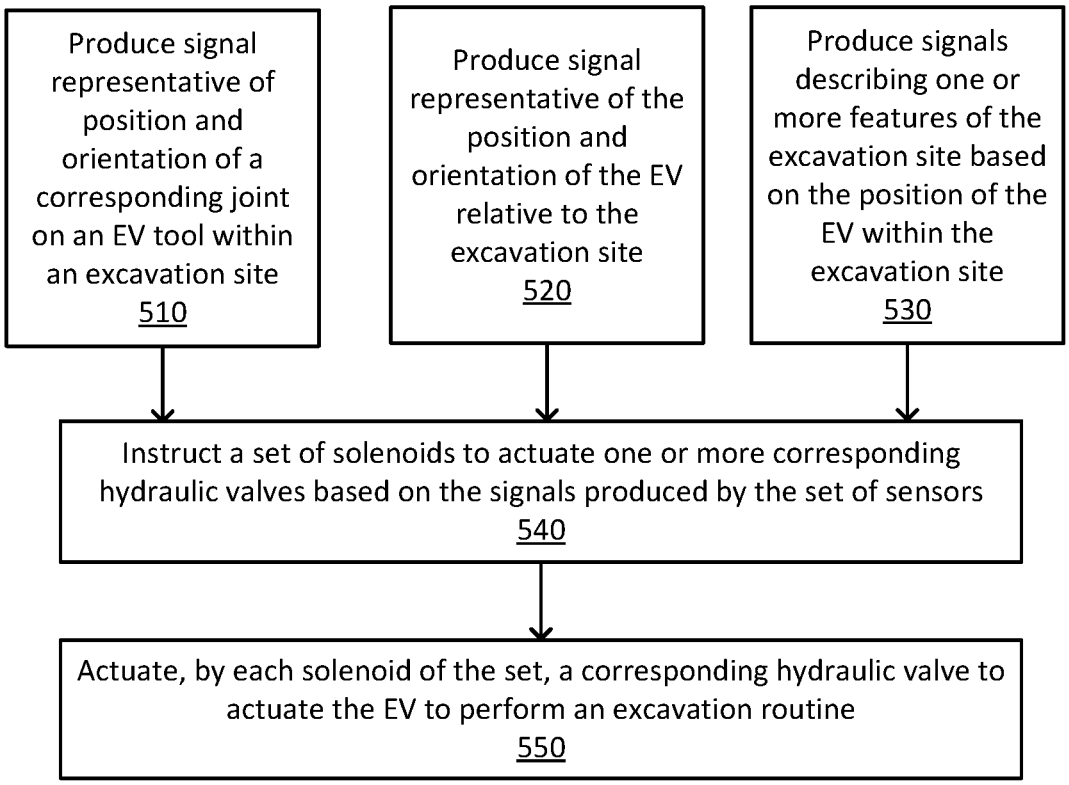
FIG. 5 shows an example flowchart describing the process for hydraulically actuating an excavation vehicle, according to an embodiment.

As described above with reference to FIG. 3A, some configurations of the excavation vehicle 115 may include a hydraulic actuation system. In such configurations, the actuation assembly 300 further comprises a solenoid coupled to the controller 330 and a hydraulic valve. In response to a signal from the controller 330, the solenoid actuates the hydraulic valve to adjust the distribution of hydraulic pressure within the excavation vehicle 115. FIG. 5 shows an example flowchart describing the process hydraulically actuating an excavation vehicle 115, according to an embodiment. The actuation assembly 300 produces 510 signals representative of the position and orientation of a corresponding joint on the excavation tool 175 within an excavation site. The actuation assembly 300 produces 520 signals representative of the position and orientation of the excavation vehicle 115 relative to an object within the excavation site. The actuation assembly 300 produces 530 signals describing one or more features of the excavation site based on the position of the excavation vehicle within the excavation site. Based on the produced signals, the actuation assembly 300 instructs 540 a set of solenoids to actuate one or more corresponding hydraulic valves based on the signals produced by the set of sensors and each solenoid actuates 550 a corresponding hydraulic valve to actuate the excavation vehicle 115 to perform an excavation routine.

IV. Additional Considerations

It is to be understood that the figures and descriptions of the present disclosure have been simplified to illustrate elements that are relevant for a clear understanding of the present disclosure, while eliminating, for the purpose of clarity, many other elements found in a typical system. Those of ordinary skill in the art may recognize that other elements and/or steps are desirable and/or required in implementing the present disclosure. However, because such elements and steps are well known in the art, and because they do not facilitate a better understanding of the present disclosure, a discussion of such elements and steps is not provided herein. The disclosure herein is directed to all such variations and modifications to such elements and methods known to those skilled in the art.

Some portions of above description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

While particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A system for enabling actuation in an excavation vehicle, comprising:

a first set of one or more sensors, each sensor of the first set configured to couple to a different corresponding joint of an excavation tool of the excavation vehicle, and each configured to produce a signal representative of a position and orientation of the corresponding joint relative to an excavation site;

a second set of one or more sensors, each sensor of the second set configured to couple to the excavation vehicle and to produce a signal representative of a position and orientation of the excavation vehicle relative to the excavation site;

a third set of one or more sensors, each sensor of the third set configured to couple to the excavation vehicle and to produce signals describing one or more features of the excavation site based on the position of the excavation vehicle relative to the excavation site;

a set of solenoids, each solenoid of the set of solenoids configured to couple to a corresponding hydraulic valve of the excavation tool and to actuate the corresponding hydraulic valve; and a controller communicatively coupled to the first set of sensors, the second set of sensors, and the third set of sensors and configured to produce and communicate actuating signals to each solenoid of the set of solenoids to control joints of the excavation tool to autonomously perform an excavation routine based on the signals produced by the first set of sensors, the second set of sensors, and the third set of sensors.

2. The system of claim 1, wherein the set of solenoids convert an electrical signal for actuating joints of the excavation tool into an electrical signal for actuating one or more valves physically coupled to the excavation tool.

3. The system of claim 1, wherein the controller is further configured to, in response to the signals produced by the first set of sensors, the second set of sensors, and the third set of sensors satisfying a stop condition, produce a stop signal to stop the excavation routine performed by the excavation tool.

4. The system of claim 1, wherein the actuating signals comprise one or more of PWM and CAN signals for driving an electronic component of the excavation vehicle associated with joints of the excavation tool.

5. The system of claim 4, wherein electronic components of the excavation vehicle include one or a combination of the following:

a switch;

a circuit; and a driver.

6. The system of claim 1, wherein one or more of the first set of sensors, the second set of sensors, and the third set of sensors wirelessly couple to the controller.

7. The system of claim 1, wherein each signal produced by a sensor of the first set of sensors is representative of a position and orientation of the corresponding joint further relative to one of: a base of the excavation vehicle and one or more features surrounding the excavation vehicle.

8. The system of claim 1, wherein the second set of sensors communicates with an external sensor located apart from the excavation vehicle, and wherein each signal produced by a sensor of the second set of sensors is representative of the position and orientation of the excavation vehicle further relative to the external sensor.

9. The system of claim 1, wherein the third set of sensors comprise a plurality of sub-groups of sensors, each sub-group configured to produce signals describing one or more features of the excavation site within a field of view corresponding to the sub-group of sensors.

10. The system of claim 1, wherein a third subset of the set of sensors comprises a plurality of sub-groups of sensors, each sub-group configured to produce signals describing one or more features of the excavation site within a field of view corresponding to the sub-group of sensors.

11. A system for enabling actuation in an excavation vehicle, comprising:

a set of sensors configured to produce signals representative of 1) a position and orientation of an excavation tool of the excavation vehicle, 2) a position and orientation of the excavation vehicle within an excavation site, and 3) geographic features of the excavation site within a threshold distance of the excavation vehicle;

a set of solenoids, each solenoid of the set of solenoids configured to couple to a corresponding hydraulic valve of the excavation tool, each solenoid configured to actuate the corresponding hydraulic valve; and a controller configured to couple to the set of solenoids and to perform an excavation routine by instructing the set of solenoids to actuate one or more corresponding hydraulic valves based on the signals produced by the set of sensors.

12. The system of claim 11, wherein the set of solenoids convert an electrical signal for actuating joints of the excavation tool into an electrical signal for actuating one or more valves physically coupled to the excavation tool.

13. The system of claim 11, wherein the controller is further configured to, in response to the signals produced by the set of sensors satisfying a stop condition, produce a stop signal to stop the excavation routine performed by the excavation tool.

14. The system of claim 11, wherein the actuating signals comprise one or more of PWM and CAN signals for driving an electronic component of the excavation vehicle associated with joints of the excavation tool.

15. The system of claim 14, wherein electronic components of the excavation vehicle include one or a combination of the following:

a switch;

a circuit; and a driver.

16. The system of claim 11, wherein one or more of the set of sensors wirelessly couple to the controller.

17. The system of claim 11, wherein each signal produced by a first subset of the set of sensors is representative of a position and orientation of the corresponding joint further relative to one of: a base of the excavation vehicle and one or more features surrounding the excavation vehicle.

18. The system of claim 11, wherein a second subset of the set of sensors communicates with an external sensor located apart from the excavation vehicle, and wherein each signal produced by a sensor of the second subset is representative of the position and orientation of the excavation vehicle further relative to the external sensor.

19. An excavation vehicle comprising:

a first set of one or more sensors, each sensor of the first set configured to couple to a different corresponding joint of an excavation tool of the excavation vehicle, and each configured to produce a signal representative of a position and orientation of the corresponding joint relative to an excavation site;

a second set of one or more sensors, each sensor of the second set configured to couple to the excavation vehicle and to produce a signal representative of a position and orientation of the excavation vehicle relative to the excavation site;

a third set of one or more sensors, each sensor of the third set configured to couple to the excavation vehicle and to produce signals describing one or more features of the excavation site based on the position of the excavation vehicle relative to the excavation site;

a set of solenoids, each solenoid of the set of solenoids configured to couple to a corresponding hydraulic valve of the excavation tool and to actuate the corresponding hydraulic valve; and a controller communicatively coupled to the first set of sensors, the second set of sensors, and the third set of sensors and configured to produce and communicate actuating signals to each solenoid of the set of solenoids to control joints of the excavation tool to autonomously perform an excavation routine based on the signals produced by the first set of sensors, the second set of sensors, and the third set of sensors.

20. The excavation vehicle of claim 19, wherein the set of solenoids convert an electrical signal for actuating joints of the excavation tool into an electrical signal for actuating one or more valves physically coupled to the excavation tool.

* * * * *